US010240279B2

(12) United States Patent
Wong et al.

(10) Patent No.: US 10,240,279 B2
(45) Date of Patent: Mar. 26, 2019

(54) STEAM DEVICE WITH A NOISE GENERATOR

(71) Applicant: KONINKLIJKE PHILIPS N.V., Eindhoven (NL)

(72) Inventors: William Wai Lik Wong, Eindhoven (NL); Luck Wee Png, Eindhoven (NL); Mohankumar Valiyambath Krishnan, Eindhoven (NL); Miling Vishwas Date, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 20 days.

(21) Appl. No.: 15/500,559

(22) PCT Filed: Aug. 18, 2015

(86) PCT No.: PCT/EP2015/068881

§ 371 (c)(1),
(2) Date: Jan. 31, 2017

(87) PCT Pub. No.: WO2016/030224

PCT Pub. Date: Mar. 3, 2016

(65) Prior Publication Data

US 2017/0218563 A1 Aug. 3, 2017

(30) Foreign Application Priority Data

Aug. 26, 2014 (EP) ..... 14182193

(51) Int. Cl.

| | |
|---|---|
| ***D06F 75/12*** | (2006.01) |
| ***D06F 75/14*** | (2006.01) |
| ***D06F 75/38*** | (2006.01) |

(52) U.S. Cl.
CPC ..... *D06F 75/12* (2013.01); *D06F 75/14* (2013.01); *D06F 75/38* (2013.01)

(58) Field of Classification Search
CPC ..... D06F 75/00; D06F 75/02; D06F 75/06; D06F 75/08; D06F 75/10; D06F 75/12;
(Continued)

(56) References Cited

U.S. PATENT DOCUMENTS 1,347,224 A * 7/1920 Kako ..... D06F 75/12 38/77.2
2,179,259 A * 11/1939 Jones ..... D06F 75/16 38/77.8

(Continued)

FOREIGN PATENT DOCUMENTS

CN 2274313 Y 2/1998
CN 201156417 Y * 11/2008

(Continued)

*Primary Examiner* — Ismael Izaguirre

(57) ABSTRACT

The present application relates to a steam device comprising a steam generator (60), at least one steam vent (37) through which steam is emitted from the steam device, a steam path (50) between the steam generator (60) and the at least one steam vent (37). The steam path (50) has a base (53) along which scale is able to pass. The steam device also comprises a noise generator (60) configured to act on steam generated by the steam generator (60) to generate noise. The noise generator (60) is spaced from the base (53) of the steam path (50) so that scale is not obstructed by the noise generator (60).

15 Claims, 4 Drawing Sheets

(58) Field of Classification Search
CPC ..... D06F 75/14; D06F 75/16; D06F 75/18; D06F 75/20; D06F 75/22; D06F 75/24
See application file for complete search history.

(56) References Cited

U.S. PATENT DOCUMENTS

| | | | | | |
|---|---|---|---|---|---|
| 2,188,011 | A | * | 1/1940 | Miller | D06F 75/16 38/77.81 |
| 2,819,543 | A | * | 1/1958 | Hoecker | D06F 75/16 38/77.5 |
| 2,832,160 | A | * | 4/1958 | Beach | D06F 75/14 38/77.82 |
| 3,896,572 | A | * | 7/1975 | Jeffress | D06F 75/18 38/77.83 |
| 4,821,670 | A | * | 4/1989 | Foxcroft | G10K 5/00 116/137 R |
| 5,592,763 | A | | 1/1997 | Hahnewald | |
| 7,096,612 | B2 | | 8/2006 | Lesaga | |
| 7,516,567 | B2 | | 4/2009 | Jiang | |
| 7,684,464 | B2 | | 3/2010 | Linsky | |

FOREIGN PATENT DOCUMENTS

| | | | | |
|---|---|---|---|---|
| DE | 4107236 | A1 | | 9/1992 |
| DE | 202011106502 | U1 | | 1/2012 |
| GB | 2016052 | A | | 9/1979 |
| GB | 2365028 | A | * | 2/2002 |
| JP | 61179194 | A | | 8/1986 |
| JP | 2007130127 | A | | 5/2007 |
| WO | 2013068870 | A1 | | 5/2013 |

* cited by examiner

STEAM DEVICE WITH A NOISE GENERATOR

This application is the U.S. National Phase application under 35 U.S.C. § 371 of International Application No. PCT/EP2015/068881, filed on Aug. 18, 2015, which claims the benefit of International Application No. 14182193.4 filed on Aug. 26, 2014. These applications are hereby incorporated by reference herein.

FIELD OF THE INVENTION

The present invention relates to a steam device, in particular a steam device with a noise generator.

BACKGROUND OF THE INVENTION

Steam devices, such as steam irons, are used to remove creases from fabric, such as clothing and bedding. One type of steam iron is a steam system iron. Such steam system irons comprise a base unit with a water reservoir and a steam head with steam vents from which steam is emitted. Steam is typically generated by a boiler in the base unit and fed to the steam head through a flexible hose. Other systems include a steam generator in the steam head.

When the steam head is disposed against a fabric to be treated it is difficult for a user to determine whether steam is being vented from the steam head, and so the user may not be provided with an accurate determination of the effective operation of the steam head. This may mean that the user will repeatedly remove the steam head from the fabric to be treated to check the quantity of vented steam, and so prolonging the treatment.

It is also known that prolonged use of steam devices causes mineral deposits, known as scale, to form and collect in the steam generator. The scale is left behind by the evaporated water. The accumulation of these scale deposits may reduce the efficiency of the steam iron and loose scale may block the steam vents. One means of preventing a scale build-up is the use of water treatment cartridges. However, the efficiency of such an arrangement may vary over time. Therefore, another approach is to flush the scale from the steam device along the base of a steam path and through the steam vents. However, if any obstructions are present then this may prevent the scale from being removed and so minimise the efficiency of the steam device.

GB 2,016,052 discloses a steam iron comprising a steam generator with an internal water tank having electrodes therein and a soleplate having channels for distributing steam. A conduit is provided to conduct steam from the steam generator to the channels.

SUMMARY OF THE INVENTION

It is an object of the invention to provide a steam device which alleviates or substantially overcomes the problems mentioned above.

The invention is defined by the independent claims; the dependent claims define advantageous embodiments.

According to one aspect of the present invention, there is provided a steam device comprising a steam generator, at least one steam vent through which steam is emitted from the steam device, and a steam path between the steam generator and the at least one steam vent, the steam path having a base along which scale is able to pass, characterised in that the steam device comprises a noise generator configured to act on steam generated by the steam generator to generate noise, wherein the noise generator is spaced from the base of the steam path so that scale is not obstructed by the noise generator.

With this arrangement it is possible to generate noise to provide an indication to a user as to the level of steam that is being produced and vented from the steam device. Therefore, a user is able to determine operation of the steam device without a visual indication. Scale formed in the steam generator has a free path to pass from the steam generator to outside the steam device and so a build-up of scale in the steam device is prevented.

The above arrangement provides a means to generate noise during steam discharge without unduly reducing or restricting the steam path.

The noise generator may be disposed along the steam path. With this arrangement noise is generated only when steam flows to the at least one steam vent. Therefore, accurate feedback of the level of steam flow may be provided.

The noise generator may comprise a flow disturber configured to disrupt the flow of steam. This means that noise is generated by a straightforward and simple arrangement. Therefore, the reliability of the noise generator is maximised.

The flow disturber may be a steam flow splitter configured to separate the steam flow into at least two streams. The steam flow splitter may be formed by a member extending in the steam path.

With these arrangements there are no moving parts and so the reliability of the arrangement is maximised. Furthermore, the harmonics of the noise may be easily set.

The steam path may comprise an upper face opposing the base. The flow disturber may extend from the upper face.

With this arrangement it is possible to maintain a desired minimum cross-sectional profile of the steam path whilst allowing provision of a noise generating arrangement.

The flow disturber may define a cavity.

This helps to maximise the noise level generated as the steam flows along the steam path.

The noise generator may comprise at least two flow disturbers.

With this arrangement it is possible to provide redundancy in the event of failure of one of the flow disturbers. Furthermore, it is possible to provide each of the at least two flow disturbers with different characteristics so that the harmonics and frequencies that each of the flow disturbers generates differ. Therefore a broad spectrum of sound can be generated to prevent irritation to a user.

The dimensions of at least one flow disturber may differ from the dimensions of the other at least one flow disturber.

Therefore, a broad spectrum of sound may be easily generated.

The flow disturber may comprise a channel separator extending along the steam path defining an auxiliary steam channel.

With this arrangement it is possible to easily form a steam reverberation chamber in the steam path. The noise generator may comprise a steam reverberation chamber communicating with the steam path.

With this arrangement, it is possible to maximise the minimum cross-sectional profile of the steam path whilst providing a means of generating noise in response to steam flow. By providing a reverberation chamber it is possible to maximise the noise level that a steam flow is able to generate. The noise generator may be spaced from the steam path.

A chamber edge may form the flow disturber.

With this arrangement it is possible to easily form a flow disturber without additional components. Furthermore, it is possible to simplify the flow path of steam required to generate the desired level of noise, without creating obstacles against which scale may collate.

The steam device may further comprise a flow stabiliser configured to stabilise the steam flow and direct the steam flow towards the flow disturber.

By providing a flow stabiliser it is possible to stabilise and guide the steam flow. Therefore, the stabilised steam flow may be directed to the flow splitter to provide a more efficient noise generator.

The flow stabiliser may be a surface inclined with respect to the base.

Therefore, flow stabilisation may be easily obtained and further components are not required.

The steam reverberation chamber may be configured to form a resonating chamber.

With this arrangement it is possible to maximise the sound quality of the noise generated. This means that the noise may be more readily identified by a user.

The steam reverberation chamber may be configured to generate multiple resonant frequencies.

Therefore, multiple frequencies and harmonics may be generated to produce a sound spectrum proximate to white noise.

The steam device may further comprise a steam head, a base unit with a liquid reservoir, and a water path, wherein the steam generator is in the steam head and the water path fluidly communicates the steam generator with the liquid reservoir.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
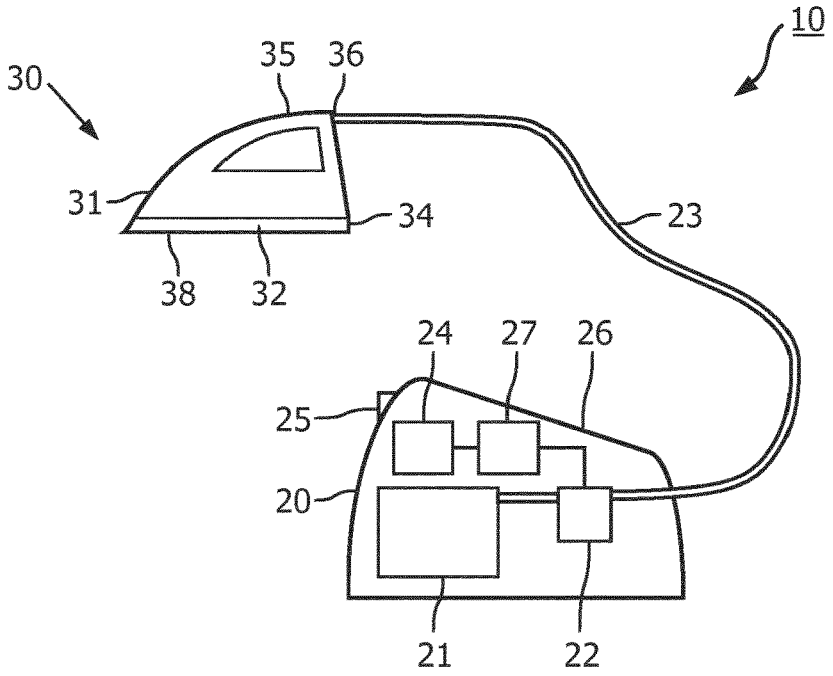
FIG. 1 shows a perspective view of a steam system iron with a base unit and a steam head according to the present invention.

A steam system iron 10, acting as a steam device, is shown in FIG. 1 comprising a base unit 20 and a steam head 30. The steam system iron 10 is configured to generate steam to be emitted against a fabric to be treated. Although the invention will be described herein by reference to a steam system iron, it will be understood that alternative arrangements are envisaged. For example, the steam device may be a handheld steam iron, a garment steamer or a wallpaper steamer.

The base unit 20 has a water reservoir 21 in which water to be converted into steam is received. A pump 22 is provided to supply water from the water reservoir 21 to the steam head 30. The base unit 20 fluidly communicates with the steam head 30 via a hose 23. The hose 23 is configured to allow the flow of water from the base unit 20 to the steam head 30. The hose 23 includes a tube (not shown) forming a path along which water is able to flow. The pump 22 is configured to urge water to flow along the hose 23 to the steam head 30. The hose 23 may also include, for example, at least one communication cable (not shown) along which electrical power and/or control signals may be sent between the base unit 20 and the steam head 30.

The base unit 20 also includes a power supply unit 24 for supplying power to components of the steam system iron 20. A user input 25 is on the base unit 20 for controlling operation of the steam system iron 20. The user input 25 may alternatively, and also, be on the steam head 30. The base unit 20 also has a stand 26 for receiving the steam head 30. A controller 27 is configured to operate the steam system iron 10.

Figure 2:
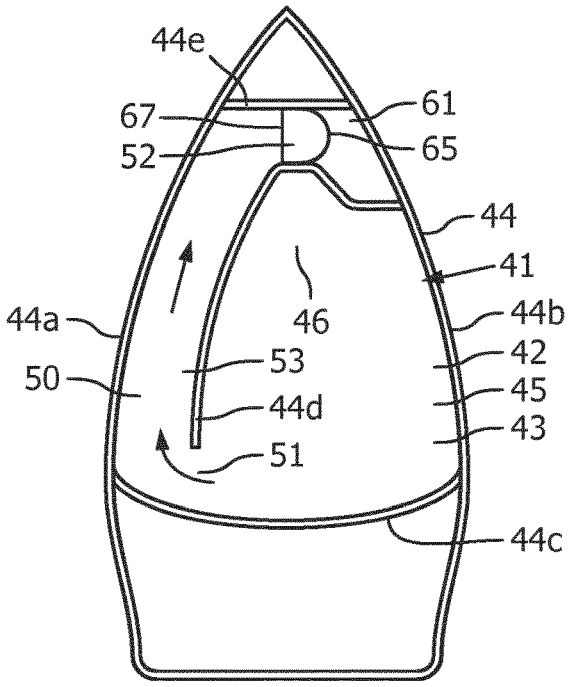
FIG. 2 shows a schematic cut-away view from above of the steam head shown in FIG. 1 according to the present invention.
Figure 3:
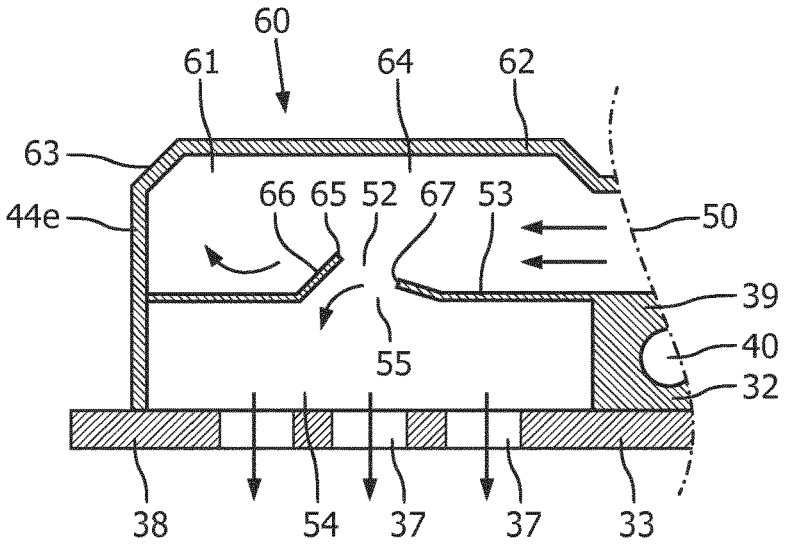
FIG. 3 shows a schematic cross-sectional view of part of the steam head shown in FIG. 2 according to the present invention.

Referring to FIGS. 1 to 3, the steam head 30 has a housing 31 and a soleplate 32. The soleplate 32 defines a lower end of the steam head 30. The housing 31 comprises a handle 35. The handle 35 enables a user to hold and manoeuvre the steam head 30.

The steam head 30 comprises a water inlet 36 through which water is supplied to the steam head 30. A water feed (not-shown) is configured to regulate the mass-flow of water being fed to the soleplate 32 from the water inlet 36.

The soleplate 32 has a soleplate panel 39. The steam head 30 has steam vents 37 (refer to FIG. 3) through which steam flows from the steam head 30. The steam vents 37 are in the soleplate 32. A fluid path is defined from the water inlet 36 to the steam vents 37. A steam generator 41 is disposed along the fluid path. The steam head 30 has a fabric contact surface 38. The fabric contact surface 38 is formed by an ironing plate 33 of the soleplate panel 39. The fabric contact surface 38 is configured to be positioned against a fabric to be treated. The steam vents 37 are formed through the ironing plate 33 to open to the steam contact surface 38. The fabric contact surface 38 is planar.

A lower side of the ironing plate 33 of the soleplate panel 39 defines the fabric contact surface 38. The soleplate panel 39 is formed from a heat conductive material, for example aluminium. The soleplate panel 39 is formed from a plurality of layers, for example in the present embodiment the ironing plate 33 of the soleplate panel 39 has a non-stick layer (not shown). The soleplate panel 39 may be formed from a single layer. The soleplate panel 39 may have at least one chamber or pathway defined therein.

The steam vents 37 are formed in the soleplate panel 32. Although three steam vents 37 are shown, it will be understood that the number of steam vents 37 may vary. One steam vent may be present, or a plurality of steam vents 37 distributed along the fabric contact surface 38.

A heater 40 is received in the soleplate panel 39. The heater 40 extends longitudinally along the soleplate panel 39. The heater 40 has a U-shaped arrangement with the apex of the heater 40 disposed proximal to a front end of the steam head. The heater 40 is substantially internally received in the soleplate panel 39. The heater 40 conducts heat to the soleplate panel 39, when operated. It will be understood that the arrangement of the heater 40 may differ.

In the present embodiment, the steam generator 41 is in the steam head 30. The steam generator 41 is configured to evaporate water into steam. Water provided to the water inlet 36 is fed to the steam generator 41 to be converted to steam. Steam generated by the steam generator 41 is fed to the steam vents 37 to exit the steam head 30. A steam path 50 is defined between the steam generator 41 and the steam vents 37. The steam path 50 defines a pathway along which steam is able to flow.

The steam generator 41 has a steam generating chamber 42. The steam generating chamber 42 is in the steaming head 30. The soleplate 32 defines the steam generating chamber 42. The steam generating chamber 42 is formed by an upper face 43 of the soleplate panel 39 and sidewalls 44. A cover wall 62 (refer to FIG. 3) encloses the steam generating chamber 42. The sidewalls 44 upstand from the upper face 43 of the soleplate panel 39. The sidewalls 44 comprise a left peripheral wall 44*a*, a right peripheral wall 44*b*, a rear wall 44*c* and an internal wall 44*d*. The steam generating chamber 42 is defined between the right peripheral wall 44*b*, the rear wall 44*c* and the internal wall 44*d*. A first section of the upper face 43 of the soleplate panel 39 confined by these walls 44*b*, 44*c*, 44*d* defines a steam generating surface 45.

The steam generator 41 comprises the water feed (not shown) through which water is fed from the water inlet 36. The water feed is on the cover wall 62. The cover wall 62 is formed from a heat conductive material, for example aluminium, although alternative arrangements are envisaged. The sidewalls 44 extend to the cover wall 62.

The water feed (not shown) is arranged to feed water onto the steam generating surface 45. The water feed is disposed proximate to the front end of the steam head. A water dosing region 46 of the steam generating surface 45 is defined opposite the water feed. The water dosing region 46 corresponds to the apex of the heater 40. It will be understood that the apex of the heater will form the hottest part of the steam generating surface 45. The water feed (not shown) is configured to be adjustable to control the feed rate of water onto the dosing region 46. Adjustment of the water feed (not shown) is operated by a valve (not shown). The valve (not shown) may be in the base unit 20.

The soleplate 32 defines the steam path 50. The steam path 50 defines a pathway from the steam generating chamber 42 along which steam generated in the steam generating chamber 42 is able to flow. The steam path 50 has a steam path inlet 51 which communicates with the steam generating chamber 42. The steam path inlet 51 communicates with the steam generating chamber 42 at a rear end 34 of the soleplate 32. That is, the steam path inlet 51 communicates with the steam generating chamber 42 distal to the dosing region 46.

The steam path 50 has a steam path outlet 52. Steam flows through the steam path outlet 52 to the steam vents 37. The steam path 50 is a channel. The steam path 50 is formed by the soleplate 32. The steam path 50 extends between the steam path inlet 51 and the steam path outlet 52.

The steam path 50 is formed by the upper face 43 of the soleplate panel 39 and the sidewalls 44 of the soleplate 32. The steam path 50 is defined between the left peripheral side wall 44*a* and the internal wall 44*d*. A second section of the upper face 43 of the soleplate panel 39 defines a base 53 of the steam path 50. The base 53 extends between the steam path inlet 51 and the steam path outlet 52. As the base 53 is formed by the upper face 43 of the soleplate panel 39, it will be understood that the base 53 will be heated by the heater 40 and so forms a secondary steam generating surface. This helps to prevent condensation passing to the steam path outlet 52. The internal wall 44*d* is spaced from the rear wall 44*c* to provide an opening forming the steam path inlet 51. In one alternative, an opening is formed in the internal wall 44*d* to form the steam path inlet 51.

The steam path 50 is elongate. The steam path outlet 52 is disposed at an opposing end of the steam path 50 to the steam path inlet 51. The steam path outlet 52 has a discharge chamber 54. The discharge chamber 54 distributes steam to the steam vents 37. The steam vents 37 extend from the discharge chamber 54 to outside the steam head 30. The discharge chamber 54 is in fluid communication with the steam path 50 so that steam flowing along the steam path 50 passes through the discharge chamber 54 to the steam vents 37. A passage 55 communicates the steam path 50 with the discharge chamber 54. In the present embodiment, the cross-sectional area of the passage 55 corresponds generally to, or is greater than, the cross-sectional area of the steam path 50. Therefore, scale passing along the steam path 50 is prevented from causing a restriction at the passage 55. The discharge chamber 54 may be omitted, for example, in an embodiment with one steam vent 37.

A noise generator 60 is at the steam path outlet 52. The noise generator 60 is configured to act on steam flowing along the steam path 50 to the steam vents 37. The noise generator 60 is configured to act on steam flowing along the steam path 50 to generate noise.

The noise generator 60 comprises a steam reverberation chamber 61. The steam reverberation chamber 61 is at the steam path outlet 52. The steam reverberation chamber 61 extends from the steam path 50. In the present embodiment, the steam reverberation chamber 61 is formed by the sidewalls 44, including a front wall 44*e* (refer to FIG. 2) defining an end wall of the steam reverberation chamber 61, the cover wall 62 and soleplate panel 39. However, it will be understood that other arrangements are possible.

The shape of the steam reverberation chamber 61 is configured to avoid the formation of single resonant frequencies. In the present embodiment, corners 63 of the steam reverberation chamber 61 are chamfered. However, alternative configurations may alternatively or also be used. For example, the sections of the sidewalls 44 forming the reverberation chamber 61 may be curved, and/or the sections of the sidewalls 44 may be angled at non-perpendicular angles to each other.

By changing the size and shape of the steam reverberation chamber 61 it is possible to determine different frequencies and harmonics. Therefore, it is possible to determine desired frequencies of noise with the steam reverberation chamber 61. For example, the front wall 44*e* may have a curved arrangement.

A chamber entrance 64 of the steam reverberation chamber 61 communicates with the steam path 50. In the present embodiment, the cross-sectional area of the chamber entrance 64 to the steam reverberation chamber 61 corresponds generally to, or is greater than, the cross-sectional area of the steam path 50. This restricts scale passing along the steam path 50 from causing a restriction at the chamber entrance 64. The chamber entrance 64 is partially defined by a chamber edge 65 of the steam reverberation chamber 61. The chamber edge 65 extends in the steam path 50. In the present embodiment, the chamber edge 65 extends along a lower side of the steam reverberation chamber 61, although other arrangements are possible. The chamber edge 65 is arcuate. Alternatively the chamber edge is linear or has another profile shape to achieve desired harmonics and/or frequencies. In the present embodiment, the chamber edge 65 is formed by an inclined lip 66, although the inclined lip may be omitted. The chamber edge 65 extends at the passage communicating the steam path 50 with the discharge chamber 54.

The chamber edge 65 acts as a flow disturber. That is, the chamber edge 65 is configured to disrupt the flow of steam. The chamber edge 65 is a steam flow splitter. The chamber edge 65 acts to separate the steam flow into two streams. The steam path 50 and the chamber edge 65 are arranged so that steam flowing along the steam path 50 intersects with the chamber edge 65. That is, steam flowing along the steam path 50 is urged to separate into two separate flow streams by the chamber edge 65. A first flow stream above the chamber edge is urged to flow into the steam reverberation chamber 61, and a second flow stream is urged to flow directly into the discharge chamber 54.

A flow stabiliser 67 is arranged to stabilise the steam flow at the steam path outlet 52. The flow stabiliser 67 in the present embodiment is an inclined plane. The inclined plane is configured as a planar ramp. The flow stabiliser 67 may be omitted. In the present embodiment, the flow stabiliser 67 is at the end of the base 53.

The flow stabiliser 67 is also configured to direct the steam flow at the steam path outlet 52 to the chamber edge 65, acting as a flow disturber. Therefore, the flow stabiliser 67 is configured to direct stabilised steam flow to the flow disturber.

Operation of the steam system iron 10 will now be described with reference to FIGS. 1 to 3. To operate the steam system iron 10, acting as a steam device, the user fills the water reservoir 21 with water, or another suitable liquid. The controller 27 is configured to control the steam system iron 10. That is, the controller 27 is configured to operate, for example, the water pump 22, the heater 40 and the water feed (not shown). The controller 27 operates the steam system iron 10 in response to operation of the user input 25.

Water is fed from the water reservoir 21 and along the hose 23 by the water pump 22. Water is fed to the water inlet 36 of the steam head 30. The heater 40 is operated and provides heat energy to the soleplate panel 39. Therefore, the soleplate panel 39 is heated. The temperature of the soleplate panel 39, and therefore the steam generating surface 45, is controlled by the controller 27 with reference to a thermostat (not shown). Once the temperature of the steam generating surface 45 is equal to or greater than a predefined level the controller 27 operates the water feed (not shown). Water is fed into the steam generating chamber 41. Water fed into the steam generating chamber 41 comes into contact with the dosing region 46 of the steam generating surface 45 and is evaporated. Water is therefore converted into steam in the steam generating chamber 41.

As steam is generated, a steam flow is produced due to the increased pressure caused due to the water evaporation in the steam generating chamber 41. As the path to the steam vents 37, and therefore, outside the steam head 30, from the steam generating chamber 41 is open, steam is urged to flow along the steam path 50. Steam in the steam generating chamber 41 flows though the steam path inlet 51 and along the steam path 50. The steam then flows to the steam path outlet 52. The rate of steam flow is dependent on the rate at which steam is produced.

Steam flows to the steam path outlet 52. The steam path 50 is configured so that steam flowing from the steam path 50 flows over the flow stabiliser 67. The steam flow flows over the inclined plane of the flow stabiliser 67 and is regulated due to the flow being urged to change direction. This causes a stable high velocity steam flow. The flow stabiliser 67 directs the steam flow towards the chamber edge 65 acting as a flow disturber. That is, the chamber edge 65 is configured to intersect the steam flow. The steam flow is then urged to separate by the chamber edge 65. The chamber edge 65 is configured as a flow splitter. The first flow stream produced flows above the chamber edge 65. The first flow stream is directed into the steam reverberation chamber 61. The second flow stream produced flows below the chamber edge 65. The second flow stream is directed to flow directly into the discharge chamber 54.

As the steam flow is split by the chamber edge 65, the flow becomes unstable and oscillates on each side of the chamber edge 65. This generates a string of pressure pulses that radiate as sound waves. This helps generate noise. The first flow stream is directed into the steam reverberation chamber 61, in which standing waves are excited by the oscillating first flow stream. Therefore, the frequency of the oscillations are stabilised and the noise generated is amplified. Due to the configuration of the steam reverberation chamber 61, the formation of single resonant frequencies is prevented and so multiple resonant frequencies and their harmonics are generated. By preventing a single resonant frequency it is possible to restrict the generation of a noise that will cause discomfort to a user.

The steam flow exiting the steam reverberation chamber 61 flows back through the chamber entrance 64 and combines with steam flowing from the steam path 50. This steam may then either flow back into the steam reverberation chamber 61 or into the discharge chamber 54 and through the steam vents 37.

The second flow stream is directed through the passage 55 to the discharge chamber 54. The second flow stream oscillates on the lower side of the chamber edge 65. Therefore, a noise is generated. The second flow stream flows through the discharge chamber 54. It will be understood that a secondary flow stabiliser (not shown) in discharge chamber 54 may help to stabilise the combined flow. The steam then flows out of the steam vents 37 to exit the steam head 30. The steam is therefore directed onto fabric against which the fabric contact surface 38 is positionable.

With this arrangement the steam flow generates a noise which can be clearly heard by a user. Therefore, the user is easily able to determine when the steam head 30 is operational without visual indicators. This is particularly useful because it is difficult to view steam flow from the steam vents 37 when the steam device 30 is positioned against a fabric to be treated. Therefore, it is possible to provide a good level of feedback to a user.

During use of the device, water is evaporated on the steam generating surface 45. As water is evaporated, mineral deposits may be formed on the steam generating surface 45. These mineral deposits are known as scale. Scale tends to build-up on a surface and then flake away to form scale particles. To restrict blockages, an unobstructed path is provided to allow the passage of scale particles from the steam generator chamber 42 to the steam vents 37. By providing a noise generator formed by a chamber, it is possible to remove scale particles without obstruction. Furthermore, any scale particles that are received in the steam reverberation chamber 61 are able to be removed. This arrangement also means that the base 53 of the steam path 50 can be planar without any obstructions upstanding therefrom which may impair the flow of scale particles along the steam path 50. This means that scale, and liquid, are free to flow along the base 53 of the steam path 50 without restriction.

Figure 4:
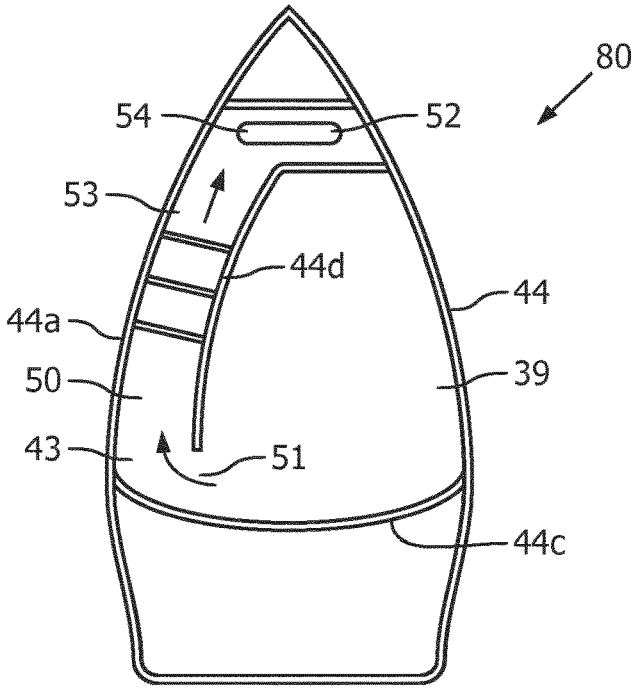
FIG. 4 shows a schematic cut-away view from above of another embodiment of the steam head shown in FIG. 1 according to the present invention.
Figure 5:
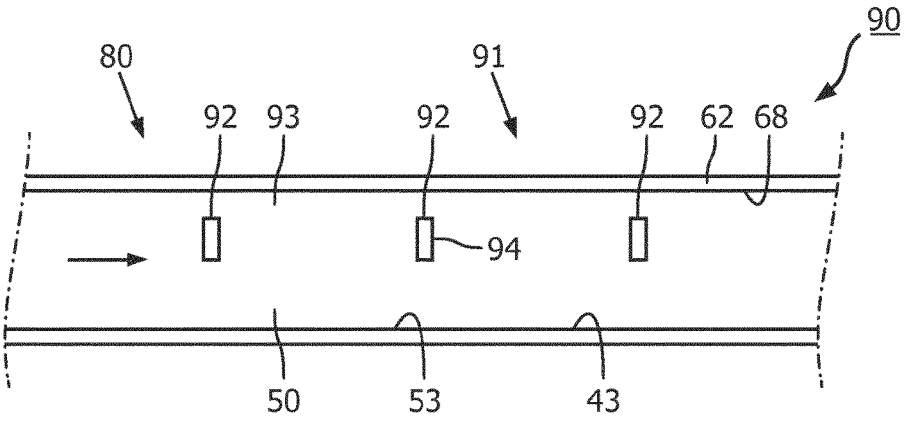
FIG. 5 shows a schematic cut-away side view of part of a steam path of the embodiment of the steam head shown in FIG. 4 according to the present invention.

Although in the above described embodiments, the noise generator 60 is at the steam path outlet 52, it will be understood that the noise generator may be disposed elsewhere on the steam pathway from the dosing region 46 to the steam vents 37. Furthermore, it will be understood that alternative arrangements for a noise generator configured to act on steam generated by the steam generator 41 are envisaged. For example, further embodiments of a steam head 80 for the steam generator system iron 10 are shown in FIGS. 4 to 7. One embodiment is shown in FIGS. 4 and 5. These figures show cut-away views of the steam head 80. Features and components of this embodiment are generally the same as those of the embodiments of the steam head described above with reference to FIGS. 1 to 3, and so a detailed description will be omitted. Furthermore, terms and reference numerals will be retained. However, in this embodiment a noise generator 90 is disposed along the steam path 50.

Referring to FIGS. 4 and 5, a cut-away plan view of the steam head 80 and a cutaway side view of the steam path 50 is shown. The arrangement of the steam path 50 is generally the same as the steam path 50 of the embodiments described above and so a detailed description will be omitted.

The steam path 50 of this embodiment comprises the steam path inlet 51 and the steam path outlet 52. Steam flows through the steam path outlet 52 to the steam vents (not shown in FIGS. 4 and 5). The steam path outlet 52 communicates with the steam vents 37 via the discharge chamber 54. It will be understood that the discharge chamber 54 may be omitted.

The steam path 50 is elongate. The steam path outlet 52 is disposed at an opposing end of the steam path 50 to the steam path inlet 51. The steam path 50 is formed by the upper face 43 of the soleplate panel 39 and the sidewalls 44 of the soleplate 32. The steam path 50 is defined between the left peripheral side wall 44*a* and the internal wall 44*d*. A second section of the upper face 43 of the soleplate panel 39 defines a base 53 of the steam path 50. The base 53 extends between the steam path inlet 51 and the steam path outlet 52. As the base 53 is formed by the upper face 43 of the soleplate panel 39, it will be understood that the base 53 will be heated by the heater (not shown in FIGS. 4 and 5) and so forms a secondary steam generating surface. This helps to prevent condensation passing to the steam path outlet 52. The internal wall 44*d* is spaced from the rear wall 44*c* to provide an opening forming the steam path inlet 51. In one alternative, an opening is formed in the internal wall 44*d* to form the steam path inlet 51.

The cover wall 62 defines an upper face 68 of the steam path 50. The cover wall 62 is formed from a heat conductive material, for example aluminium, although alternative arrangements are envisaged. The sidewalls 44 extend to the cover wall 62.

In this embodiment, the noise generator 90 is in the steam path 50. The noise generator 90 comprises a resonating member arrangement 91. The resonating member arrangement 91 comprises multiple (three are shown) resonating members 92. It will be understood that the number, pitch and position of resonating members 92 may vary to achieve desired harmonics and/or frequencies.

Each resonating member 92 extends across the steam path 50, perpendicular to the direction of steam flow. That is, each resonating member 92 extends perpendicular to the longitudinal axis of the steam path 50. Each resonating member 92 extends between the sidewalls 44*a*, 44*d*. The resonating member 92 may be integrally formed. Each resonating member 92 is spaced from the upper face 68 of the steam path 50. A space 93 is defined between the upper face 68 and each resonating member 92. Each resonating member 92 is spaced from each adjacent resonating member 92.

Each resonating member 92 is spaced from the base 53 of the steam path 50. That is, an unobstructed passage is defined between each resonating member 92 and the base 53. Therefore, the base 53 of the steam path 50 can be planar without any obstructions upstanding therefrom which may impair the flow of scale particles along the steam path 50. This means that scale, and liquid, are free to flow along the base 53 of the steam path 50 without restriction.

Each resonating member 92 has a leading edge 94. The leading edge 94 of each resonating member 92 is the edge proximal to the steam path inlet 51. In the present embodiment, the leading edge 94 is planar. The leading edge 94 extends perpendicular to the steam flow. Each resonating member 92 has a rectangular profile.

Figure 6:
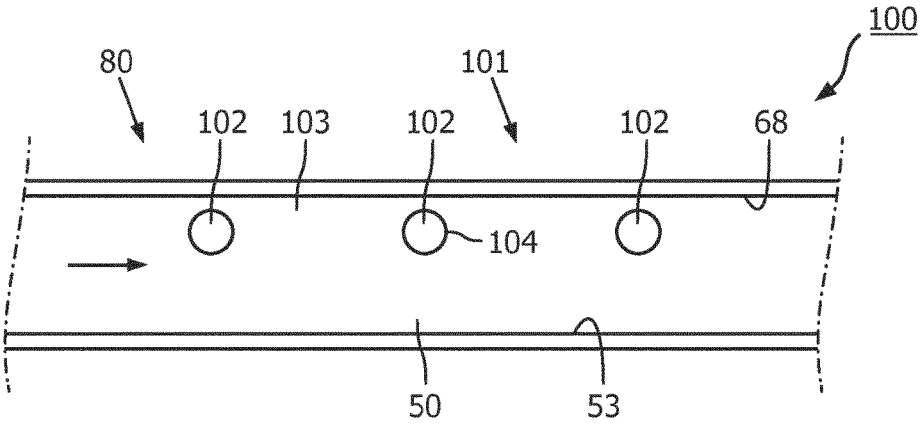
FIG. 6 shows a schematic cut-away side view of another embodiment of part of a steam path of the embodiment of the steam head shown in FIG. 4 according to the present invention.

However, it will be understood that the shape of the resonating member 92 may vary. For example, an alternative resonating member arrangement 101 of a noise generator 100 is shown in FIG. 6. In this arrangement, three resonating members 102 are shown having a circular profile. That is, each resonating member 102 is cylindrical. Each resonating member 102 is spaced from the upper face 68 of the steam path 50 by a space 103. Each resonating member 102 of this embodiment has a leading edge 104. The leading edge 104 is arcuate. The leading edge 104 of each resonating member 102 is the edge proximal to the steam path inlet 51.

When the steam device 80 is operated, steam is generated in the steam generator 41 as described above. The steam flows into the steam path 50 through the steam path inlet 51 and flows therealong. The steam flows past the resonating member arrangement 91 to the steam path outlet 52. As the steam flows along the steam path 50, the resonating members 92 intersect the steam flow. Each resonating member 92 generates flow turbulence in substantially laminar steam flow along the steam path 50. Therefore, the high velocity steam flowing along the steam path 50 moves past the leading edges 94 of the resonating members 92 and a flow induced sound is generated. The leading edge 94 acts as a flow disturber. That is, the leading edge 94 is configured to disrupt the flow of steam. The leading edge 94 is a steam flow splitter. The leading edge 94 acts to separate the steam flow into two streams. The frequencies and their harmonics may be calculated using Strouhals formula. The spacing of the resonating members 92 from the upper face 68 of the steam path 50 causes a split in the steam flow to cause two flow streams above and below the resonating members 92.

Figure 7:
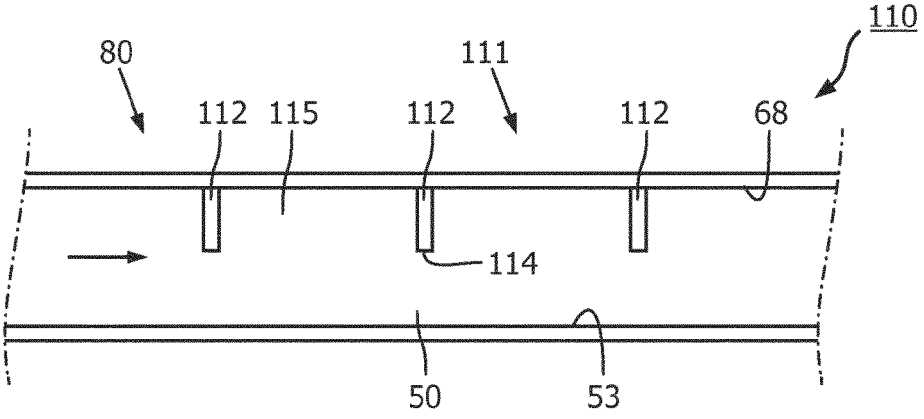
FIG. 7 shows a schematic cut-away side view of another embodiment of part of a steam path of the embodiment of the steam head shown in FIG. 4 according to the present invention.

Referring to FIG. 7, although in the above described embodiments, the resonating members are spaced from the upper face 68 of the steam path 50, in an alternative embodiment a noise generator 110 is in the steam path 50 having a resonating member arrangement 111 with resonating members 112 protruding from the upper face 68. In such an embodiment, each resonating member 112 extends into the steam path 50, and therefore into the steam flow through the steam path 50. A free edge 114 of each resonating member 112 acts to create flow turbulence in the substantially laminar flow along the steam path 50. Therefore, the high velocity steam flowing along the steam path 50 moves past the free edges 114 of the resonating members 112 and a flow induced sound is generated. The free edge 114 acts as a flow disturber. That is, the free edge 114 is configured to disrupt the flow of steam. A cavity 115 is formed by each resonating member 112 downstream of the free edge 114. This creates a space into which oscillating waves from the free edge 114 may radiate. The cavity helps to maximise the noise level generated. Each resonating member 112 is spaced from the base 53 of the steam path 50. That is, an unobstructed passage is defined between each resonating member 112 and the base 53. Therefore, the base 53 of the steam path 50 can be planar without any obstructions upstanding therefrom which may impair the flow of scale particles along the steam path 50. This means that scale, and liquid, are free to flow along the base 53 of the steam path 50 without restriction.

Although in the above described embodiment, each resonating member 112 has an equal length, it will be understood that the length of adjacent resonating members 112 may vary. Similarly, the shape of adjacent resonating member 112 and/or the distance between adjacent resonating member 112 of an array of resonating member 112 may vary.

Although in the above described embodiment the resonating members are beams protruding from the upper face 68, it will be understood that alternative arrangements are possible. For example, in one arrangement the resonating members extending from the upper face 68 are ridges formed in the upper face 68. The upper face 68 may have a corrugated arrangement to form resonating members.

Figure 8:
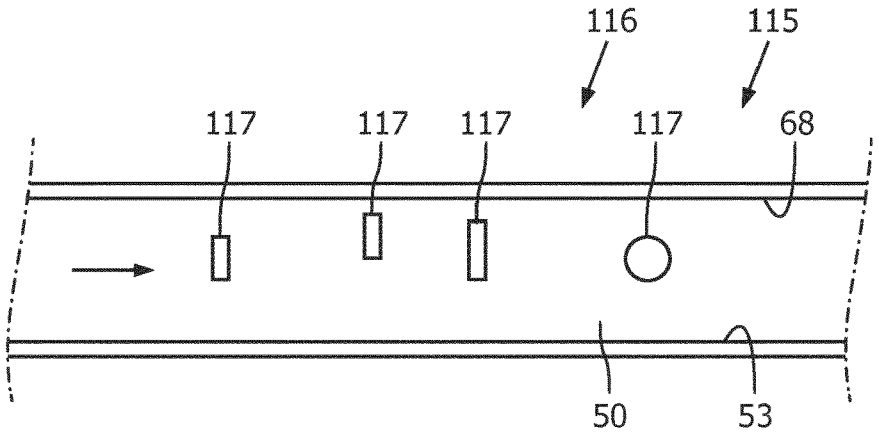
FIG. 8 shows a schematic cut-away side view of another embodiment of part of a steam path of the embodiment of the steam head shown in FIG. 4 according to the present invention.

Referring to an alternative resonating member arrangement 115 of a noise generator 116 shown in FIG. 8, it will also be understood that the arrangement of each adjacent resonating member 117 in a noise generator may vary. This provides for each resonating member 117 to have a different effect on the steam flow through the steam path. With such an arrangement, the frequencies and their harmonics generated by each resonating member 117 will vary. This helps to generate a large spectrum of sound. Therefore, irritation to a user may be minimised. For example, the cross-sectional profile, spacing from the upper face 68, dimensions and/or rigidity of the resonating members 117 may be varied.

In one embodiment, adjacent resonating members 117 are spaced from the upper face 68 by different distances. For example, the height of the space between the upper face 68 and one resonating member may be half the height of the space between the upper face 68 and an adjacent resonating member 68. Such an arrangement is shown in FIG. 8.

Although in above described embodiments each resonating member 92, 102, 112 has an equal length, it will be understood that the length of adjacent resonating members 117 may vary, an example of which is shown in FIG. 8. Similarly, the shape of adjacent resonating member 117 and/or the distance between adjacent resonating member 117 of an array of resonating member 117 may vary, an example of which is shown in FIG. 8. With such an arrangement, the frequency and their harmonics generated by each resonating member will vary.

Figure 9:
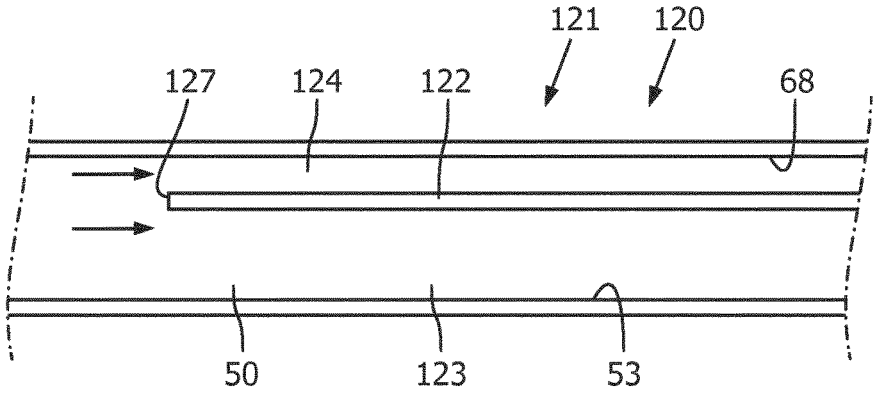
FIG. 9 shows a schematic cut-away side view of another embodiment of part of a steam path of the embodiment of the steam head shown in FIG. 1 according to the present invention.

Referring to FIG. 9, a further embodiment of an alternative resonating member arrangement 121 of a noise generator 120 is shown. Features and components of this embodiment are generally the same as those of the embodiments of the steam head described above, and so a detailed description will be omitted. In this embodiment, a channel separator 122 is disposed in the steam path 50.

The channel separator 122 is elongate. The channel separator 122 extends along the steam path 50. The channel separator 122 divides the steam path 50 into a primary steam channel 123 and an auxiliary steam channel 124. The channel separator 122 is spaced from the upper face 68 to define the auxiliary steam channel 124. The channel separator 122 is spaced from the base 53 to define the primary steam channel 123. The channel separator 122 extends between side walls. The channel separator 122 forms the noise generator 120. The channel separator 122 acts as a flow disturber. An edge 127 of the channel separator 122 acts as a flow splitter. The auxiliary steam channel 124 acts as a reverberation chamber similar to the steam reverberation chamber 61 (as shown in FIG. 3).

Figure 10:
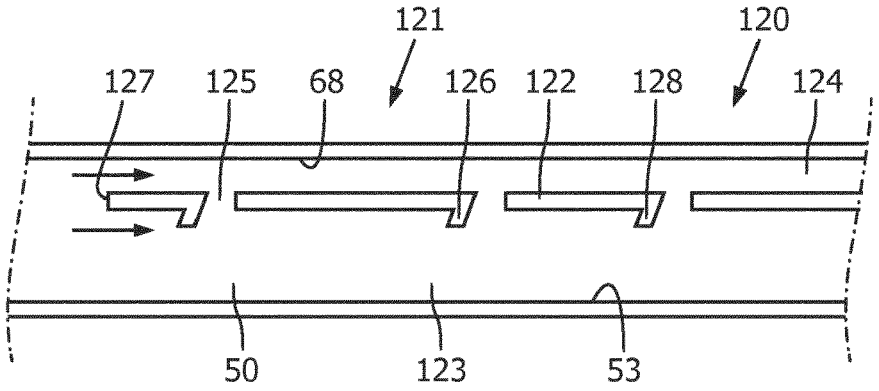
FIG. 10 shows a schematic cut-away side view of another embodiment of part of a steam path of the embodiment of the steam head shown in FIG. 1 according to the present invention.

In a further embodiment, as shown in FIG. 10, communication openings 125 are formed along the channel separator 122. The communication openings 125 fluidly communicate between the primary steam channel 123 and the auxiliary steam channel 124. The number of communication openings 125 may vary. Furthermore, the spacing between communication openings 125, the size of adjacent communication openings 125 and/or the shape of adjacent communication openings 125 may vary. In the present embodiment, a tab 126 descends from the upstream edge of each communication opening 125 into the primary steam channel 123. At least one of the tabs 126 may extend into the auxiliary steam channel 124. Each tab 126 may be omitted. The length of each tab 126 may be varied. Each tab 126 helps to promote turbulence to maximise the generation of noise. Each tab 126 is spaced from the base 53. A free end 128 of each tab 126 extends in an upstream direction in the steam path 50. It will be understood that the arrangement of each tab 126 may differ in dependence on the desired noise type.

Although embodiments of a noise generator are described separately above, it will be understood that two or more embodiments, or features of two or more embodiments, may be used in combination with each other in order, for example, to generate different noise effects or to increase the volume of the noise levels. In one embodiment, the flow stabiliser is used in combination with a noise generator disposed in the flow path to stabilise steam flow that has flowed past the noise generator prior to being vented from the steam vents.

Although in the above described embodiments the steam generator is in the steam head, it will be understood that the steam generator may be in the base unit. In such an arrangement, steam flows from the base unit along a steam path defined by the hose 23.

Although in the embodiments described herein the pump is in the base unit, it will be understood that, in an alternative embodiment, the pump is in the steam head.

In one embodiment, the water reservoir is in the steam head. In such an arrangement the base unit may be omitted. In such an arrangement, the water reservoir, pump and steam generator are in the steam head. Such an arrangement is a handheld steam iron.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A steam device comprising a steam generator, at least one steam vent through which steam is emitted from the steam device, and an essentially elongate steam path between the steam generator and the at least one steam vent, the steam path having a base along which scale is able to pass, wherein the steam path is formed by an upper face of a soleplate panel, a left peripheral sidewall, and an internal sidewall, and wherein a second section of said upper face of the soleplate panel defines said base of the steam path, wherein the steam path is essentially parallel to the longitudinal length of the upper face of the soleplate panel, wherein the steam device comprises a noise generator configured to act on steam generated by the steam generator to generate noise to provide an indication as to whether steam is flowing in the steam device, wherein the noise generator is spaced from the base of the steam path so that scale is not obstructed by the noise generator.

2. The steam device according to claim 1, wherein the noise generator is disposed along the steam path.

3. The steam device according to claim 1, wherein the noise generator comprises a flow disturber configured to disrupt the flow of steam.

4. The steam device according to claim 3, wherein the flow disturber is a steam flow splitter configured to separate the steam flow into at least two streams.

5. The steam device according to claim 4, wherein the steam flow splitter is formed by a member extending in the steam path.

6. The steam device according to claim 3, wherein the steam path comprises an upper face opposing the base, wherein the flow disturber extends from the upper face.

7. The steam device according to claim 6, wherein the flow disturber defines a cavity.

8. The steam device according to claim 3, wherein the noise generator comprises at least two flow disturbers.

9. The steam device according to claim 8, wherein the dimensions of at least one flow disturber differs from the dimensions of the other at least one flow disturber.

10. The steam device according to claim 3, wherein the flow disturber comprises a channel separator extending along the steam path to form an auxiliary steam channel.

11. The steam device according to claim 3, wherein the noise generator comprises a steam reverberation chamber communicating with the steam path.

12. The steam device according to claim 11, wherein a chamber edge forms the flow disturber.

13. The steam device according to claim 12, further comprising a flow stabiliser configured to stabilise the steam flow and direct the steam flow towards the flow disturber.

14. The steam device according to claim 11, wherein the steam reverberation chamber is configured to form a resonating chamber.

15. A steam device according to claim 1, comprising a steam head, a base unit with a liquid reservoir, and a water path, wherein the steam generator is in the steam head and the water path fluidly communicates the steam generator with the liquid reservoir.

* * * * *